United States Patent [19]

Hefti et al.

[11] Patent Number: 4,889,655

[45] Date of Patent: Dec. 26, 1989

[54] MIXTURES OF FLUORESCENT WHITENING AGENTS

[75] Inventors: Heinz Hefti, Reinach; Klaus Artz, Muttenz; Kurt Weber; Kurt Burdeska, both of Basel, all of Switzerland; Dieter Reinehr, Kandern, Fed. Rep. of Germany

[73] Assignee: Ciba-Geigy Corporation, Ardsley, N.Y.

[21] Appl. No.: 280,107

[22] Filed: Dec. 5, 1988

Related U.S. Application Data

[63] Continuation of Ser. No. 34,519, Apr. 6, 1987, abandoned.

[30] Foreign Application Priority Data

Apr. 18, 1986 [CH] Switzerland ..... 1566/86

[51] Int. Cl.[4] ..... C09K 11/06

[52] U.S. Cl. ..... 252/301.22; 252/301.21; 252/301.24; 252/301.28

[58] Field of Search ..... 252/301.21, 301.22, 252/301.24, 301.28

[56] References Cited

U.S. PATENT DOCUMENTS

| | | | |
|---|---|---|---|
| 4,008,166 | 2/1977 | Luthi | 252/301.24 |
| 4,108,887 | 8/1978 | Fleck et al. | 252/301.21 |
| 4,196,229 | 4/1980 | Fleck et al. | 252/301.21 |
| 4,336,155 | 6/1982 | Martini et al. | 252/301.22 |
| 4,338,079 | 6/1983 | Suzuki et al. | 252/301.21 |
| 4,363,744 | 12/1983 | Gunther et al. | 252/301.22 |
| 4,447,350 | 5/1984 | Martini et al. | 252/301.22 |

*Primary Examiner*—John F. Niebling
*Assistant Examiner*—Steven P. Marquis
*Attorney, Agent, or Firm*—Edward McC. Roberts

[57] ABSTRACT

Mixtures of fuorescent whitening agents comprising 5 to 45 parts by weight of 4,4'-bis(cyanovinyl)stilbene and 95 to 55 parts by weight of a compound of formula

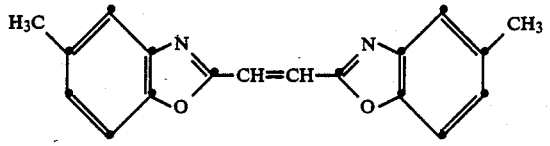

or

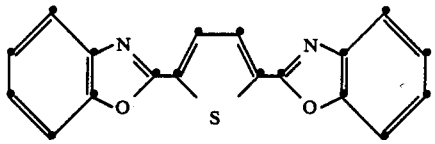

and the use of said mixtures and compositions containing them for whitening polyester fibres and textile material containing polyester fibres.

3 Claims, No Drawings

MIXTURES OF FLUORESCENT WHITENING AGENTS

This is a continuation of application Ser. No. 034,519 filed on April 6, 1987 now abandoned.

Fluorescent whitening agents are often used as mixtures of two or more different types. The reason is that such mixtures exhibit a synergistic effect, as the degree of whiteness of the mixture is greater than that of the same amount of each of the individual components.

It has now been found that a significant enhancement of the degree of whiteness is obtained by mixing 4,4'-bis(cyanovinyl)stilbenes (disclosed in DE-A 26 02 750) with another known fluorescent whitening agent of the structural formula indicated below.

Specifically, the present invention relates to mixtures of fluorescent whitening agents comprising 5 to 45 parts by weight of the compound of formula (1)

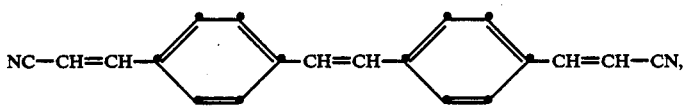

(1)

and 95 to 55 parts by weight of a compound of formula (2) or (3)

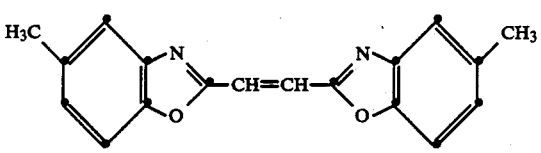

(2)

(DE-A 1 090 214), or

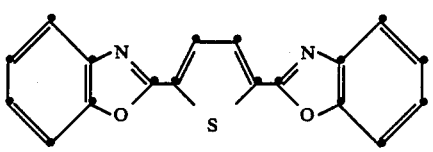

(3)

(DE-A 1 166 197),

Preferred mixtures of this invention consist of compounds of formulae (1) and (2).

The mixtures of this invention are obtained either by dispersing the compound of formula (1) jointly with a compound of formula (2) or (3) in the indicated ratio, or by dispersing the components separately and mixing them by mechanical means. The preferred ratio of components (1) to (2) or (1) to (3) is from 10 to 40 parts by weight to 90 to 60 parts by weight, preferably from 10 to 30 parts by weight to 90 to 70 parts by weight. The ratio of component (1) to component (2) is preferably from 15 to 25 parts by weight to 85 to 75 parts by weight.

Further objects of the present invention are the use of mixtures of the compound of formula (1) with a compound of formula (2) or (3) for whitening polyester fibres and textile material containing polyester fibres, as well as compositions for whitening polyester fibres and textile materials containing polyester fibres, said compositions containing a mixture of the compound of formula (1) with a compound of formula (2) or (3).

The mixtures of this invention are particularly suitable for whitening textile materials made from linear polyesters or modified polyesters. They can be applied to the textile material by known methods, for example by the exhaust process in the temperature range from 90° to 140° C., or by the pad heat process in the temperature range from 160° to 220° C.

The mixtures of the present invention have very good tinctorial properties. In addition to achieving a higher degree of white compared with corresponding amounts of the respective individual components, the mixtures induce enhanced brilliance of the white effects and good lightfastness.

The invention is illustrated by the following Examples.

EXAMPLE 1

Polyester fabric (Terylene 540) is treated at 40° C. in a dyeing machine at a liquor ratio of 1 to 20 with an aqueous bath containing 0.1% by weight of a fluorescent whitening agent comprising a mixture of 20 parts by weight of the compound of formula

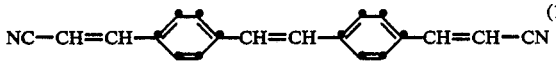

(1)

and 80 parts by weight of the compound of formula

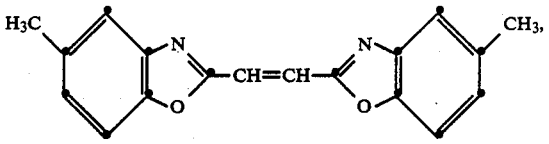

(2)

and 1 g/l of a fatty alcohol polyglycol ether. Over the course of 30 minutes the temperature is raised to 120° C. and kept for a further 30 minutes thereat. The bath is then cooled to 40° C. over 15 minutes. The goods are subjected to an after-treatment by rinsing them for 30 seconds in running deionised water, followed by drying at 180° C. An excellent white effect is obtained on the treated polyester fabric.

EXAMPLE 2

The procedure of Example 1 is repeated, using instead of the mixture of compounds of formulae (1) and (2) a mixture of 20 parts by weight of the compound of formula (1) and 80 parts by weight of the compound of formula

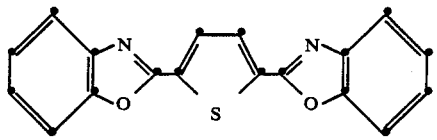

(3)

A comparably good white effect is obtained.

EXAMPLE 3

Polyester fabric (Terylene 540) is padded at room temperature with an aqueous liquor containing 0.1 g/l of a mixture of 20 parts by weight of the compound of formula (1) and 80 parts by weight of the compound of formula (2) (based on active substance) in dispersed form and 1 ml/l of Invadin JFC (200%). The pick-up is 65%.

The fabric is dried for 30 minutes at 80° C. and then thermofixed at 200° C. An excellent white effect is obtained on the polyester fabric.

EXAMPLE 4

The procedure of Example 3 is repeated, using a mixture of 20 parts by weight of the compound of formula (1) and 80 parts by weight of the compound of formula (3). A comparably good white effect is obtained.

What is claimed is:

1. A mixture of fluorescent whitening agents comprising 20 parts by weight of the compound of formula

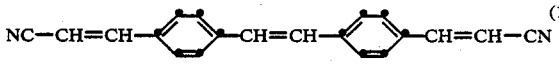

(1)

and 80 parts by weight of a compound of formula

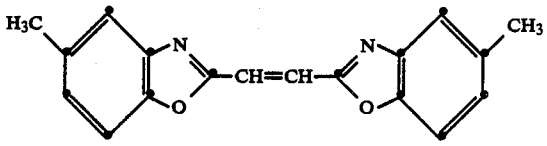

(2)

or

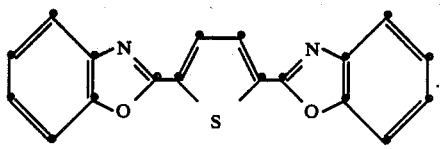

(3)

2. A mixture according to claim 1 comprising the compounds of formulae (1) and (2).

3. A composition for whitening polyester fibres and textile material containing polyester fibres, which composition contains a mixture according to claim 1 of a compound of formula (1) and a compound of formula (2) or (3).

* * * * *